US007931017B2

(12) United States Patent
Liao

(10) Patent No.: US 7,931,017 B2
(45) Date of Patent: Apr. 26, 2011

(54) ASSEMBLY STRUCTURE OF AN ACTION AND A GAS CYLINDER

(75) Inventor: Yin-Hsi Liao, Sijhih (TW)

(73) Assignee: Guay Guay Trading Co., Ltd., Taipei County (TW)

( * ) Notice: Subject to any disclaimer, the term of this patent is extended or adjusted under 35 U.S.C. 154(b) by 16 days.

(21) Appl. No.: 12/546,447

(22) Filed: Aug. 24, 2009

(65) Prior Publication Data

US 2011/0041826 A1 Feb. 24, 2011

(51) Int. Cl.
*F41B 11/00* (2006.01)

(52) U.S. Cl. ..... 124/74

(58) Field of Classification Search ..... 124/74
See application file for complete search history.

(56) References Cited

U.S. PATENT DOCUMENTS

| | | | | | |
|---|---|---|---|---|---|
| 2,375,314 | A * | 5/1945 | Mills | 124/57 |
| 2,725,048 | A * | 11/1955 | Koogle | 124/71 |
| 3,025,845 | A * | 3/1962 | Cardia et al. | 124/70 |
| 3,056,395 | A * | 10/1962 | Rudolf et al. | 124/57 |
| 3,233,600 | A * | 2/1966 | Spack | 124/74 |
| 3,463,136 | A * | 8/1969 | Joslyn et al. | 124/76 |
| 3,494,344 | A * | 2/1970 | Vadas et al. | 124/74 |
| 3,503,299 | A * | 3/1970 | Billingslea et al. | 89/7 |
| 3,548,802 | A * | 12/1970 | Green | 124/70 |
| 3,830,214 | A * | 8/1974 | Curtis | 124/57 |
| 3,951,038 | A * | 4/1976 | Van Langenhoven | 89/7 |
| 3,999,534 | A * | 12/1976 | Chapin et al. | 124/74 |
| 4,173,964 | A * | 11/1979 | Curran | 124/40 |
| 5,341,790 | A * | 8/1994 | Ebert | 124/69 |
| 5,706,795 | A * | 1/1998 | Gerwig | 124/71 |
| 6,142,058 | A * | 11/2000 | Mayville et al. | 89/126 |
| 6,276,354 | B1 * | 8/2001 | Dillon | 124/74 |
| 6,701,908 | B2 * | 3/2004 | Nibecker, Jr. | 124/69 |

* cited by examiner

*Primary Examiner* — Troy Chambers
(74) *Attorney, Agent, or Firm* — Leong C. Lei

(57) ABSTRACT

An assembly structure of an action and a gas cylinder includes a furniture which is provided with an action and an interior of the action is accommodated with a gas cylinder. A power source can be provided to the furniture by the gas cylinder. By the aforementioned structure, an issue in a conventional toy gun or training gun that when a clip is taken down, the power source is also removed is broken through. By using the present invention, when a user takes down the clip, the furniture is still provided with the power source to shoot out a last round of bullet left in the furniture, thereby enabling the present invention to be equipped with practicability and progressiveness of a realistic sparring effect.

6 Claims, 5 Drawing Sheets

ASSEMBLY STRUCTURE OF AN ACTION AND A GAS CYLINDER

BACKGROUND OF THE INVENTION a) Field of the Invention

The present invention relates to a furniture structure and more particularly to an assembly structure of an action and a gas cylinder, which is able to be applied in a shooting training.

b) Description of the Prior Art

A survival game has already been a leisure activity which people are often taking. People can use toy guns in hands to emulate a real field combat situation and can play team games with others to develop a tacit understanding of the games and to obtain an entertainment effect.

However, when shooting with a real gun, a clip should be loaded first and then a handle is pulled to feed bullets. If the clip is taken down before completely shooting the clip, then there will be one round of bullet left in a bore at this time. In addition, when the clip is reloaded after igniting the left bullet, then the handle should be pulled again to feed the bullets.

On the other hand, a toy gun usually uses air as its power source to achieve a shooting effect by air to drive the bullets in a frame and the power source can keep providing to the toy gun using only a gas cylinder in the clip, when shooting.

Nevertheless, when the aforementioned toy gun is used, following issue and shortcoming actually exist to be improved.

As the gas cylinder is provided in the clip, when a user takes down the clip after shooting, the gas cylinder is removed too. At this time, the toy gun is unable to shoot as the power source is lost. However, when shooting with the real gun, if the clip is taken down, the real gun can still shoot once as there is still one round of bullet left in the bore and this effect cannot be achieved by the toy gun or a training gun. Therefore, the improvement is actually needed.

Accordingly, how to solve the aforementioned issue and shortcoming of a prior art is a direction of improvement for research and development by the present inventor and related vendors.

SUMMARY OF THE INVENTION

The primary object of the present invention is to provide a realistic sparring structure which can be applied in a shooting training.

To achieve the aforementioned object, the present invention includes a furniture and an interior of the furniture is provided with an action into which a gas cylinder is accommodated. By the provision of the gas cylinder, a power source can be provided to the furniture.

As the gas cylinder of the present invention is provided in the action, when the user takes down the clip after shooting, one round of bullet left in the action can be still shot out by the power source provided by the gas cylinder; this improves the technology of the prior art that as the gas cylinder is provided in the clip, the bullet cannot be shot if the clip is taken down. Accordingly, by the technology of the present invention, the realistic sparring structure that can be applied in the toy gun or the training gun is achieved.

To enable a further understanding of the said objectives and the technological methods of the invention herein, the brief description of the drawings below is followed by the detailed description of the preferred embodiments.

DETAILED DESCRIPTION OF THE PREFERRED EMBODIMENTS

Figure 1:
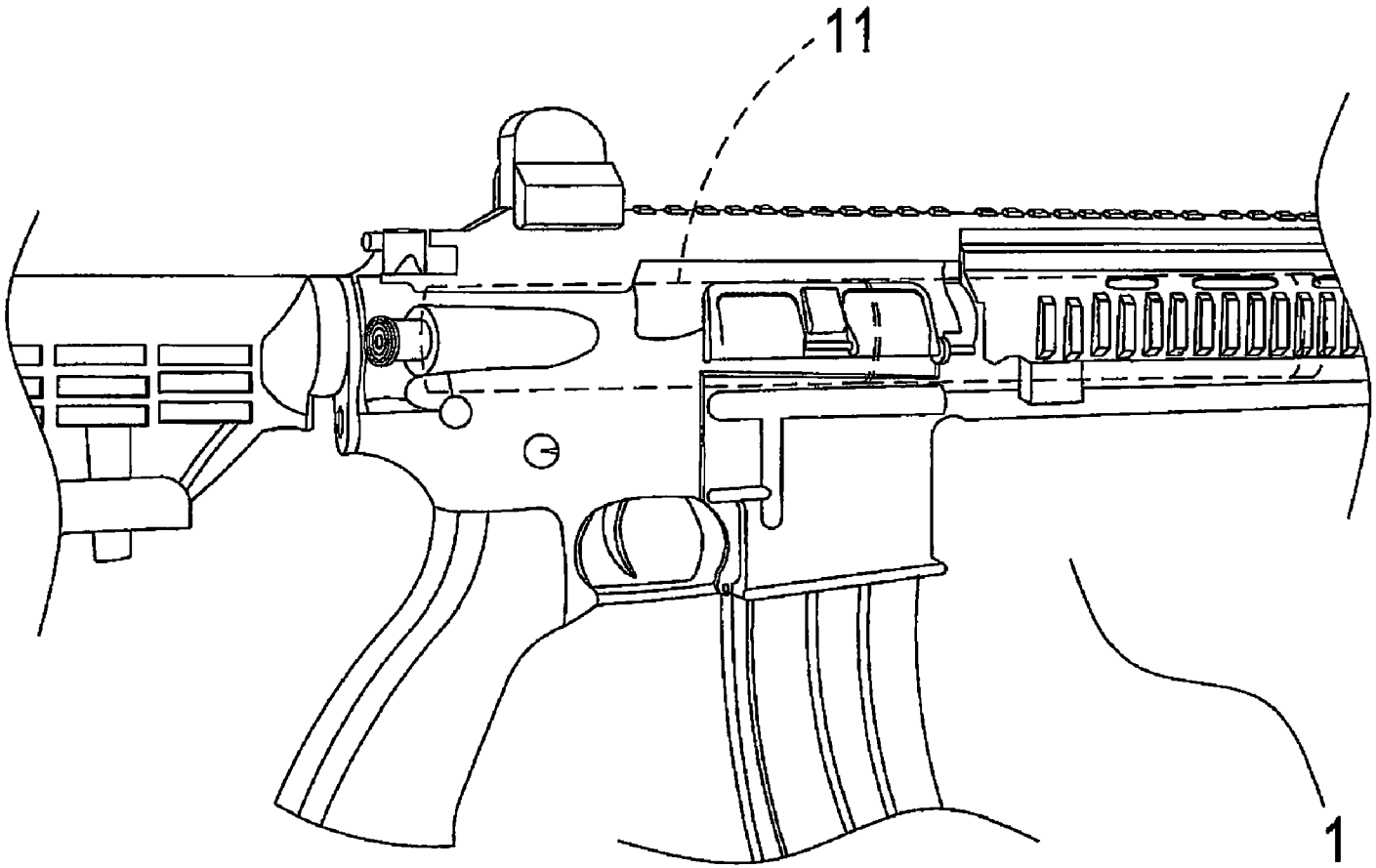
FIG. 1 shows a three-dimensional view of a preferred embodiment of the present invention.
Figure 2:
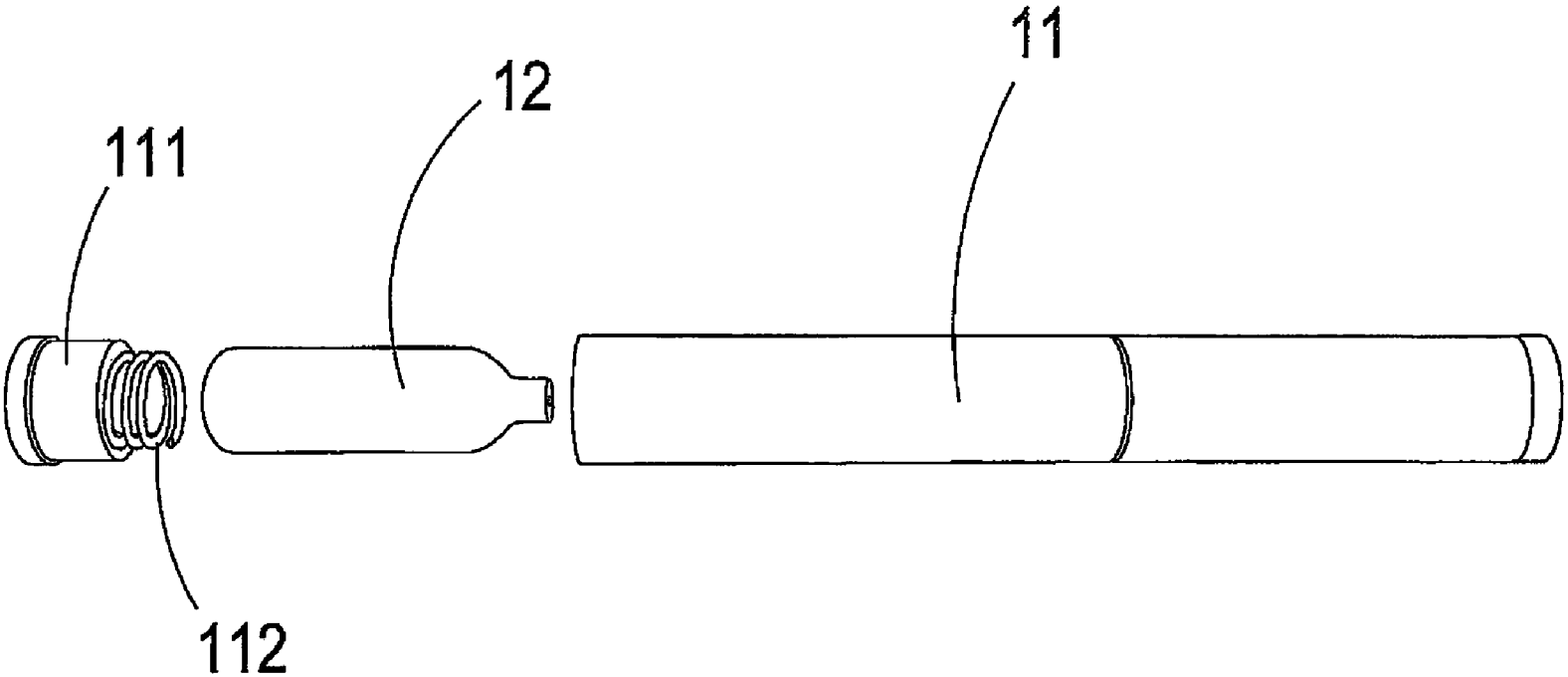
FIG. 2 shows a three-dimensional exploded view of a preferred embodiment of the present invention.
Figure 3:
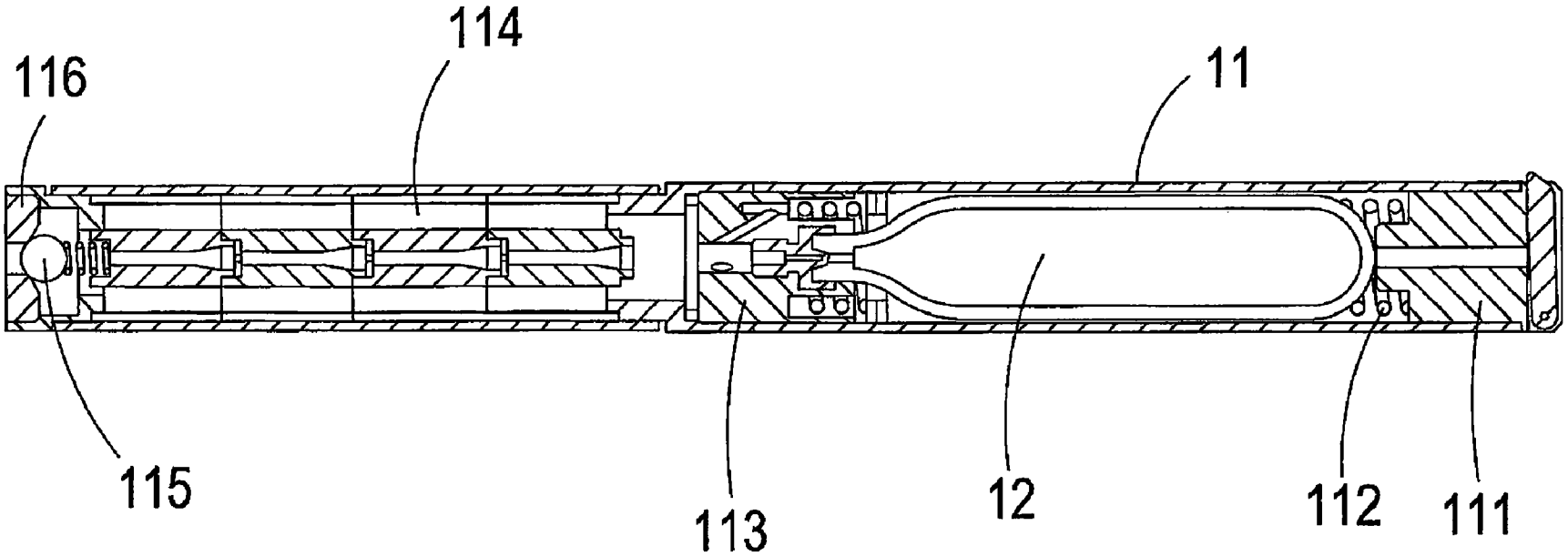
FIG. 3 shows a cutaway view of a preferred embodiment of the present invention.

Referring to FIGS. 1 to 3, it shows a three-dimensional view, a three-dimensional exploded view and a cutaway view, of a preferred embodiment of the present invention. As shown in the drawings, the present invention comprises a furniture 1 which includes an action 11 and an interior of the action 11 is accommodated with a gas cylinder 12, such that by the provision of the gas cylinder 12, a power source can be provided to the furniture 1.

The gas cylinder 12 is filled with high pressure carbon dioxide, an end of the action 11 is provided with a fixation connector 111 to fix the gas cylinder 12 and an interior of the action 11 is provided with a spring 112 which abuts the gas cylinder 12, an air inlet kit 113 and at least one heat dissipation block 114. In addition, an end of the action 11 is provided with a steel ball 115 and a vent plate 116 which abuts the steel ball 115.

Figure 4:
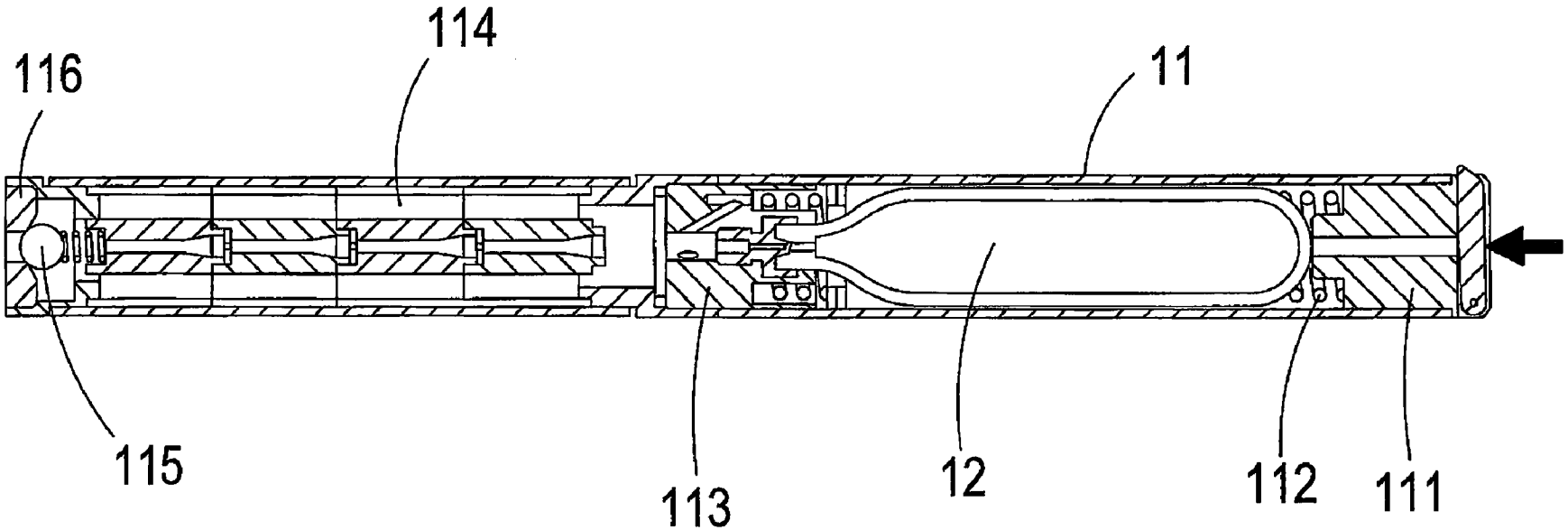
FIG. 4 shows a first schematic view of an implementation of a preferred embodiment of the present invention.
Figure 5:
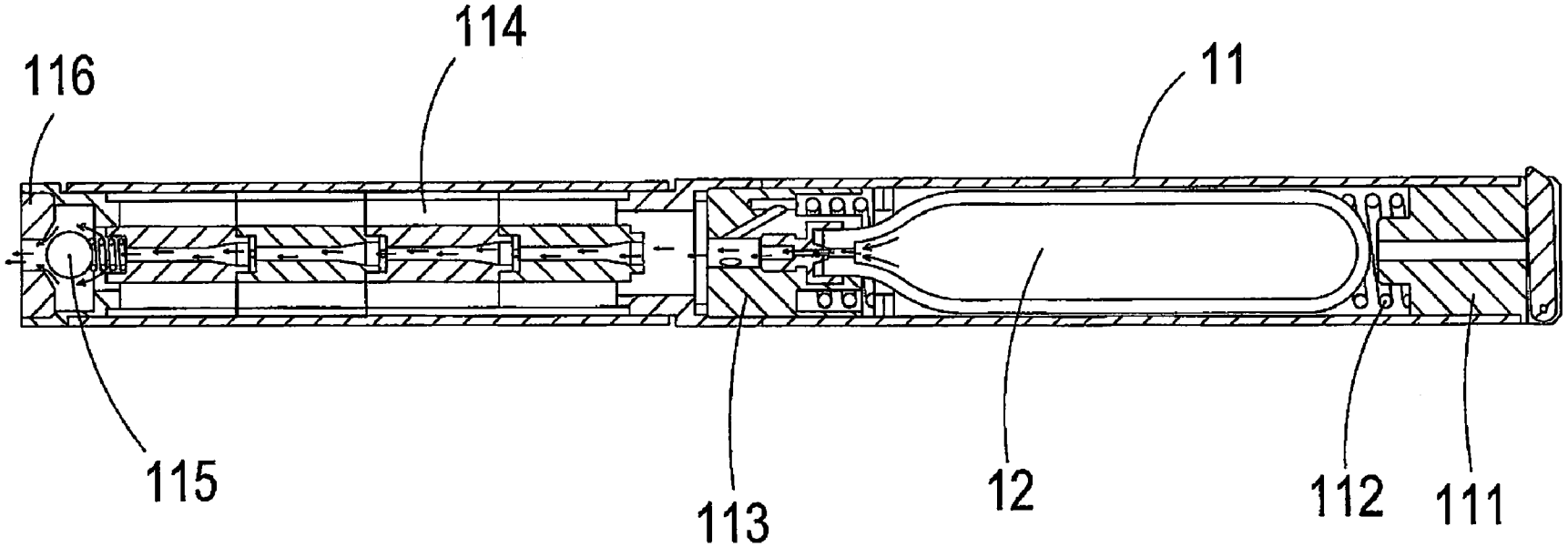
FIG. 5 shows a second schematic view of an implementation of a preferred embodiment of the present invention.

Referring to FIGS. 3 to 5, it shows a cutaway view, a first schematic view of an implementation and a second schematic view of an implementation, of a preferred embodiment of the present invention. As shown in the drawings, as the action 11 of the present invention is provided with the gas cylinder 12, when the user takes down the clip, the power source can be still provided by the gas cylinder 12 in the action 11. A principle of operation is that when the user ignites, a force will be exerted to the fixation connector 111 at one end of the action 11 and the action 11 will be pushed forward by that force. At a same time, the steel ball 115 is away from the vent plate 116 by that pushing force and high pressure air can pass through the vent plate 116 to further push a bullet to be shot out forward, so as to accomplish an ignition operation. By the present invention, when the user takes down the clip, the bullet which is left in the furniture 1 can be still ignited by the gas cylinder 12 in the action 11, thereby achieving a realistic sparring structure. Accordingly, referring to all the drawings, the present invention is indeed provided with following advantages when comparing with the prior art.

In the present invention, the gas cylinder 12 is provided in the action 11, such that when the user takes down the clip, the bullet left in the furniture 1 can be still ignited; this improves and breaks through the issue in the prior art that when the clip is taken down, the power source is also removed, as in the present invention, when the clip is taken down, the last round of bullet left in the furniture 1 can be still shot out.

It is of course to be understood that the embodiments described herein is merely illustrative of the principles of the invention and that a wide variety of modifications thereto may be effected by persons skilled in the art without departing from the spirit and scope of the invention as set forth in the following claims.

What is claimed is:

1. An assembly of an action and a gas cylinder comprising a furniture which includes an action, a gas cylinder being accommodated in the action and a power source being provided to the furniture by the gas cylinder, wherein an end of the action is provided with a steel ball and a vent plate which abuts the steel ball.

2. The assembly of an action and a gas cylinder as claimed in claim 1, wherein the gas cylinder is filled with high pressure carbon dioxide.

3. The assembly of an action and a gas cylinder as claimed in claim 1, wherein an end of the action is provided with a fixation connector to fix the gas cylinder.

4. The assembly of an action and a gas cylinder as claimed in claim 1, wherein an interior of the action is provided with a spring which abuts the gas cylinder.

5. The assembly of an action and a gas cylinder as claimed in claim 1, wherein an interior of the action is provided with an inlet kit.

6. The assembly of an action and a gas cylinder as claimed in claim 1, wherein an interior of the action is provided with at least one heat dissipation block.

* * * * *